US005144299A

United States Patent [19]

Smith

[11] Patent Number: 5,144,299

[45] Date of Patent: Sep. 1, 1992

[54] TELEMETRY POWER CARRIER PULSE ENCODER

[75] Inventor: David C. Smith, Jupiter, Fla.

[73] Assignee: United Technologies Corporation, Hartford, Conn.

[21] Appl. No.: 530,015

[22] Filed: May 29, 1990

[51] Int. Cl.[5] ..... G08C 19/16

[52] U.S. Cl. ..... 340/870.18; 340/870.31; 340/870.38; 332/174

[58] Field of Search ..... 340/870.01, 870.18, 340/870.31, 870.38, 870.24; 341/177, 64; 455/106, 107; 332/174; 375/21

[56] References Cited

U.S. PATENT DOCUMENTS 3,713,124 1/1973 Durland et al ..... 340/870.31
3,922,490 11/1975 Pettis ..... 340/870.38
4,668,950 5/1987 Russell, Jr. et al. ..... 340/870.24

*Primary Examiner*—Donald J. Yusko
*Assistant Examiner*—Michael Horabik
*Attorney, Agent, or Firm*—McCormick, Paulding & Huber

[57] ABSTRACT

A telemetry system for use in controlling the operation of sensors configured on a rotating blade of a gas turbine engine includes an oscillator for generating a power carrier signal. A mechanism is included for providing command signals that select a mode of operation of the sensors and a telemetry encoder apparatus is used to generate encoder signals for modulating the power carrier signal in accordance with the selected mode of sensor operation. Also included in the present telemetry system is a programmable switch receiving the power carrier signal for modulating the power carrier signal amplitude in accordance with the encoder signals. A resistor shunts the programmable switching mechanism, and a coil transmits the modulated power carrier signal to a transceiver positioned on the turbine blade providing control signals to the sensor and transmitting sensor information to a receiver coil off of the turbine blade.

8 Claims, 3 Drawing Sheets

TELEMETRY POWER CARRIER PULSE ENCODER

TECHNICAL FIELD

This invention relates generally towards pulse encoder circuits and more particularly towards telemetry pulse encoder circuits for use in gas turbine engines that are characterized by amplitude modulation.

BACKGROUND OF THE INVENTION

Many industrial applications, especially in high stress environments require instrumentation on moving or rotating parts. In gas turbine engines it is desirable to instrument rotating turbine blades with sensors to determine b lade parameters such as strain and temperature. Signal coupling to and power for sensors on the rotating turbine blades and circuitry in the stationary mainframe has in the past been accomplished through the use of complementary inductive coils to the respective rotating and stationary engine components. Power for the sensors can be provided by a carrier signal operating at, for example 160 kHtz, that is output from a coil on the stationary member to be received by an inductive component for powering the sensors located on the rotating member. A transmitting device is located on the rotating member for broadcasting the sensor information back to a receiver o the control unit.

As the sensors and gauges typically have several functions, it is also necessary to accomplish remote wireless transmitter function switching by sending control signals to the sensors not only to instruct the sensors to switch from between operational, standby and calibration modes, but also to select which of the sensors are to respond to the command signal. Existing systems used circuitry that requires a form of permanent memory (e.g. ROM) to be placed in the electronic circuitry. The memory is then accessed by a computer matrix addressing and reading system. This function is typically accomplished through the use of known pulse generators which are large, expensive and are limited in terms of total pulse width and the number of pulses which can be transmitted.

It would be advantageous to have a telemetry pulse encoding system for use with a sensor control system which is inexpensive and simple in construction. The present invention is directed towards such a system.

SUMMARY OF THE INVENTION

An object of the present invention is to provide for a telemetry pulse encoder apparatus for use with an electronic sensor control system which is simple and inexpensive in construction.

Another object of the present invention is to provide a telemetry pulse encoder apparatus for use with the foregoing system characterized by amplitude modulation of a telemetry power carrier signal.

Still another object of the present invention is to provide a telemetry pulse encoder apparatus of the foregoing type having amplitude modulation which needs only half of the operating power of known systems.

Another object of the present invention is to provide a telemetry pulse encoder apparatus of the foregoing type providing square wave amplitude modulation of a carrier signal without wide bandwidth circuitry.

According to the present invention, a system configured on a fixed member for controlling the operation of a sensor on a moving member includes an oscillator for generating a power carrier signal having a frequency and an amplitude, a selection mechanism for providing command signals that select a mode of operation of the sensor and a telemetry encoder apparatus for receiving the command signals and generating therefrom encoder signals for modulating the power carrier signal in accordance with the selected mode of sensor operation. Also included in the present system is a programmable switch receiving the power carrier signal for modulating the power carrier signal amplitude in accordance with the encoder signals, an impedance mechanism receiving the power carrier signal for electrically shunting the programmable switching mechanism, a transmitter mechanism :or receiving and transmitting the modulated power carrier signal and a receiver mechanism positioned on the moving member for receiving the transmitted modulated power carrier signal and providing control signals to the sensor in accordance therewith.

DESCRIPTION OF THE PREFERRED EMBODIMENT

Figure 1:
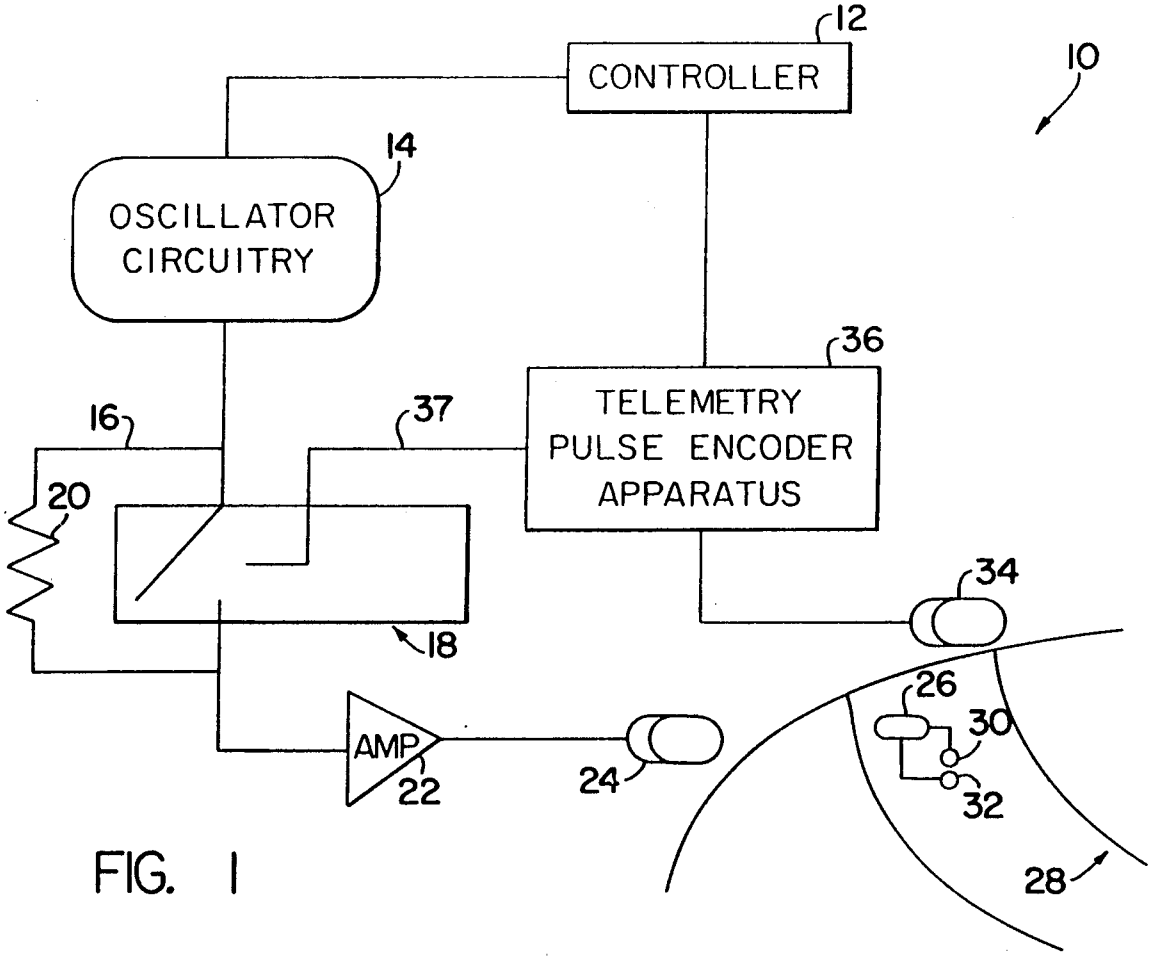
FIG. 1 is a simplified schematic illustration of an engine electronic sensor control system including a telemetry pulse encoder apparatus provided according to the present invention.

Referring now to FIG. 1 there is a schematically illustrated engine electronic sensor control system 10 provided according to the present invention. The system 10 includes a controller 12 comprised of known computer and electronic circuitry for accomplishing the control functions detailed herein. The controller provides command signals to oscillator circuitry 14 which generates 160 kHz power carrier signal at a preselected amplitude. The carrier signal is provided on line 16 to a programmable switch 18 which is configured in parallel with an impedance source, such as a shunt resistor 20, typically 100 kohm in value. As detailed hereinafter, the switch/resistor combination provides amplitude modulation to the power carrier signal.

The modulated output signal from the switch/resistor combination is presented to line driver amplification circuitry 22 to generate a signal capable of being driven into a 50 ohm load. First coil 24 receives the carrier signal and transmits that signal via electromagnetic induction to a transceiver 26 mounted on a rotating fan blade 28. The transceiver is electrically configured with sensors 30 and 32. The transceiver broadcasts the sensor signals to second coil 34. The modulated power carrier signal not only provides power to the sensors and transceiver, but also is encoded with control signals generated from a telemetry pulse encoder apparatus 36, as detailed hereinafter. The encoded control signals select which of the sensors is to be operated and in what operational mode that sensor(s) is to perform. Sensors 30, 32 preferably measure strain and temperature and are characterized by on, off and calibration operational modes.

The apparatus 36 presents on line 37 an encoder signal comprised of a sequence of digital pulses to switch 18 to amplitude modulate the power carrier signal. The encoder signal is comprised of a series of digital pulses, and opens and closes the switch in accordance therewith. When the switch is open it is bypassed by the resistor 20. This combination of resistor and switch increases the amplitude of the power carrier signal to the line driver amplifiers by approximately 40% when the switch is open. The magnitude of the shunt resistor 20 sets the modulation amplitude level for the power carrier signal.

The modulation of the power carrier signal by the telemetry pulse encoder apparatus marks a point of departure of the present invention over the prior art. It should be noted that the present invention provides extremely simple means of generating amplitude modulation. Those skilled in the art will note further that the present invention provides for very clean square wave modulation, with a minimum of distortion of the leading and trailing edges of the power carrier signal waveform.

Figure 2:
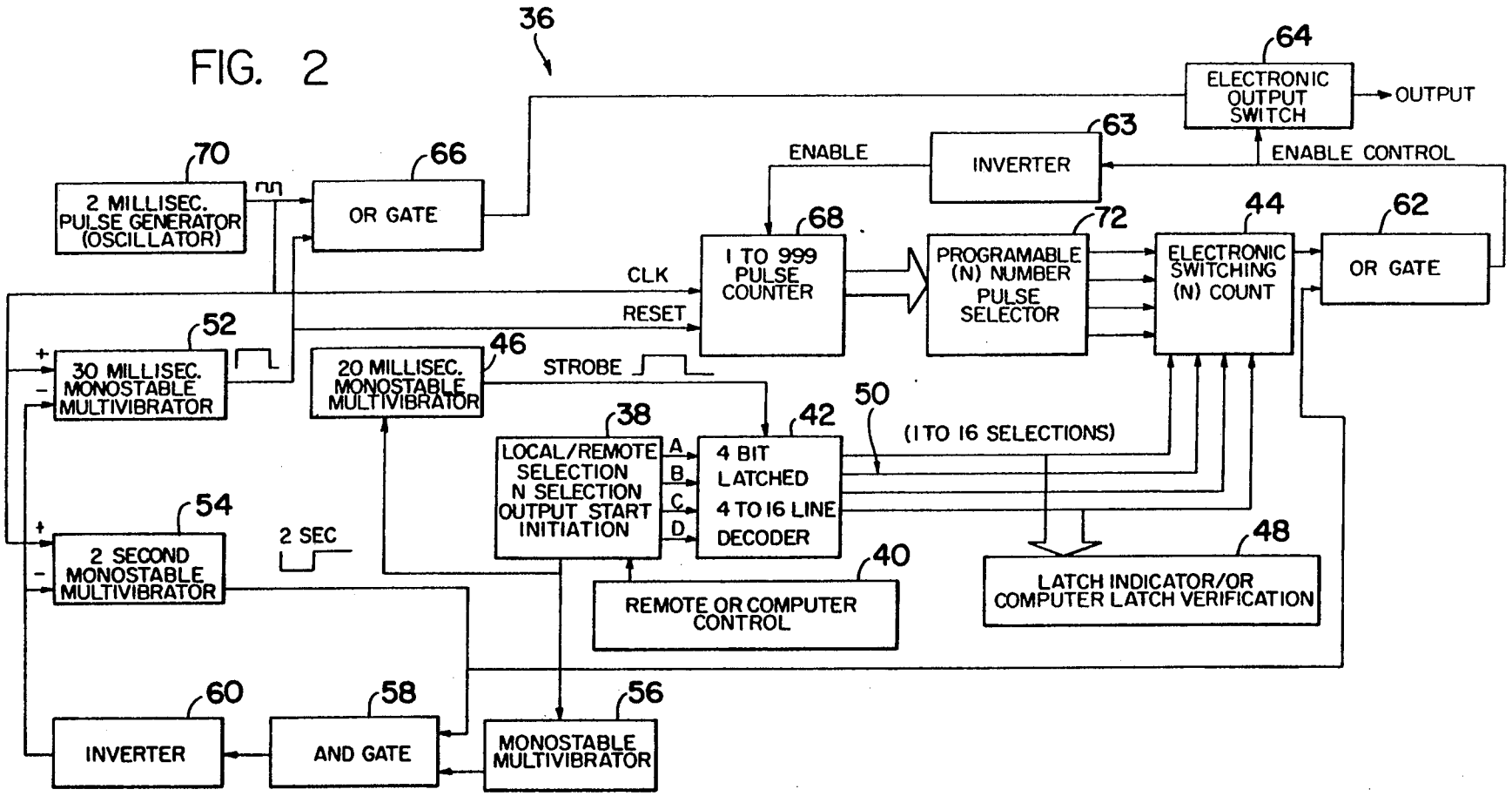
FIG. 2 is a simplified schematic illustration of the componetry which comprises the apparatus of FIG. 1.

Referring now to FIG. 2 there is shown a schematic illustration of the apparatus 36 of FIG. 1. The apparatus is generally configured to receive at block 38 a command signal preferably comprised of digital pulses corresponding to a respective one of the sensor modes of operation. The command signal is input either manually by a sequence of switches as in the preferred embodiment or remotely by means of a computer (block 40). In the preferred embodiment there are four modes of operation. Mode 1 or "gage A" enables the first strain gage sensor. Mode 2 or "gage B" enables a second sensor. "Calibration ON" instructs a sensor to operate in a calibration mode and provide signals in accord therewith, and "calibration OFF" which terminates the calibration process.

Therefore, there are four digital codes which must be initially programmed into the apparatus at decoder 42 which preferably comprises a four bit latchable 4 to 16 line decoder of a type known in the art. Signals corresponding to the number of desired counts in the selected mode of operation are presented to electronic switching counter 44 which latch the electronic switching counter into a selected count position in order that the counter will halt operation when counts received thereby are equal to the selected number. A control signal is also generated when the command signal is received to enable a 20 millisecond monostable multivibrator 46. The 20 millisecond monostable multivibrator provides a strobe pulse to latch the decoder. Verification of decoder latching (block 48) is indicated by the lighting of a lamp or equivalent indicator by a decoder output signals on lines 50.

When a selection switch is released, a 30 millisecond precision monostable multivibrator 52 and a two second monostable multi vibrator 54 are enabled by means of a signal from monostable multivibrator 56 whose output signal is summed at AND gate 58 with a signal from multivibrator 54 and is inverted by inverter 60. An output pulse from the two second monostable multivibrator is presented to OR gate 62 to close an electronic output switch 64 to prevent any other subsequently received command signal during the 2 second period to effect the operation of the apparatus and generate erroneous signals. The output signal from OR gate 62 is also presented to inverter 63 and ultimately as an enable signal to the pulse counter. The output signal from the 30 millisecond monostable multivibrator is presented first to OR gate 66 and then is passed to the output electronic switch. The signal from the multivibrator 52 also resets a programmable pulse counter 68 to a zero count and prevents the operation thereof until the end of the 30 millisecond period.

At the termination of the 30 millisecond period, counter 68 is enabled to count two millisecond pulses provided from pulse generator 70. Pulses from the pulse generator are also provided to the electronic output switch by means of OR gate 66. These pulses are allowed to pass through the electronic output switch until the preselected threshold count of two millisecond pulses is reached (block 72). At that time, a disable signal is generated by the electronic switching counter 44 to OR gate 62 and ultimately to electronic output switch and halt the operation of the counter 68.

The apparatus provided in accordance with the present invention increases the telemetry power feed signal amplitude by 40% and a preselected number pulse rate and is capable of supplying a required preamble signal which, in the preferred embodiment, comprises a 30 millisecond, 40% power increase to achieve remote wireless transmitter function switching. As noted above, the transmitters are presently in the preferred embodiment are mounted inside a rotating jet engine with operational power being supplied by an electromagnetically coupled 160 kHertz signal.

Figure 3:
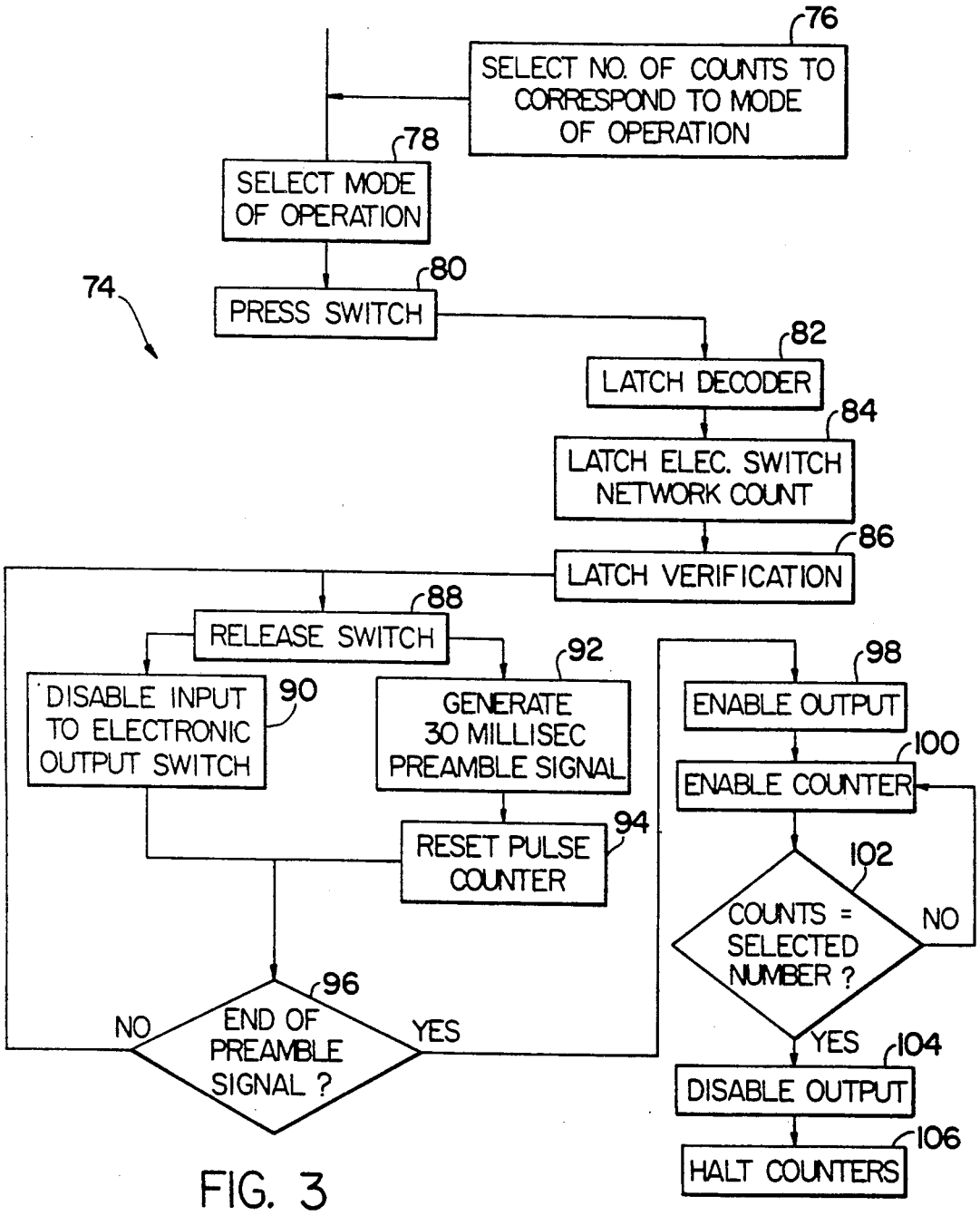
FIG. 3 is a diagrammatic illustration of the operation of the apparatus of FIG. 1.

FIG. 3 is a diagrammatic illustration of an algorithm 74 executed by the telemetry pulse encoder apparatus 36 of FIG. 1. As noted above, the number of digital pulses which correspond to the respective codes is preprogrammed at block 76 (also indicated at block 38 of FIG. 2). In operation, either the operator or a controller provides the signals to the apparatus to select the mode of operation (block 78) by depressing one of four switches (block 80). The operation of the mode select switch latches the decoder (block 82), and the electronic switching counter 44 (block 84). Verification of the latching of the decoder and the electronic switching counter is provided as well (block 86).

Once the switch has been released (block 88), the apparatus will disable the input to the electronic output switch (block 90) and generate a 30 millisecond preamble signal (block 92). The operation of the 30 millisecond monostable multivibrator 52 which generates the preamble signal is also used to reset and disable the pulse counter (block 94).

The apparatus determines the end of the preamble signal (block 96) and then enables the counter and electronic output switch (blocks 98, 100). Once the number of counts accumulated in the pulse counter is equal to the selected number of counts (block 102). The apparatus disables the electronic output switch (block 104) and halts the operation of the counters (block 106).

Similarly, although the invention has been shown and described with respect to a preferred embodiment thereof, it should be understood by those skilled in the art that various other changes, omissions and additions thereto may be made therein without departing from the spirit and scope of the present invention.

I claim:

1. A system for controlling the operation of a sensor on a moving member, said system comprising on a five member:

an oscillator means for generating a power carrier signal having a frequency and an amplitude;

a selection means for providing command signals that select a mode of operation of the sensor;

a telemetry encoder apparatus for receiving said command signals and generating therefrom encoding signals for digitally modulating said power carrier signal in accordance with said selected mode of sensor operation;

a programmable switching means receiving said power carrier signal for modulating said power carrier signal amplitude in accordance with said encoder signals;

an impedance means receiving said power carrier signal for electrically shunting said programmable switching means a transmitting means for receiving and transmitting said modulated power carrier signal; and a receiver means positioned on the moving member for providing electrical power and control signals to the sensor directly from said digitally modulated power carrier signal.

2. The system of claim 1 further comprising amplification means for receiving and amplifying said modulated power carrier signal.

3. A system configured on a fixed member for controlling the operation of a sensor on a moving member, said system comprising:

an oscillator means for generating a power carrier signal having a frequency and an amplitude;

a selection means for providing command signals that select a mode of operation of the sensor;

a telemetry encoder apparatus for receiving said command signals and generating therefrom encoder signals for modulating said power carrier signal in accordance with said selected mode of sensor operation and including an encoder means for providing signals indicative of a threshold number of digital signal pulses corresponding to said selected mode of operation of said sensor;

an electronic switching counter receiving digital signal pulses and said encoder signals, said electronic switching counter for counting said digital signal pulses and providing a half signal when the number of said digital signal pulse equals said threshold number;

a first multivibrator means for generating a signal pulse of a first preselected duration;

a digital signal pulse generator for periodically providing said digital signal pulses;

an electronic output switch for receiving and transmitting said digital signal pulses and said first multivibrator means signal in the absence of said half signal; and a control circuit for providing said digital signal pulses only after the termination of said first multivibrator means signal pulses;

a programmable switching means receiving said power carrier signal for modulating said power carrier signal amplitude in accordance with said encoder signals;

an impedance means receiving said power carrier signal for electrically shunting said programmable switching means;

a transmitter means for receiving and transmitting said modulated power carrier signal; and a receiver means positioned on the moving member for receiving said transmitted modulated power carrier signal and providing control signals to the sensor in accordance therewith.

4. The system of claim 3 wherein said control circuit further comprises a second multivibrator means for generating a signal pulse of a second preselected duration to said electronic output switch for halting the operation thereof during the duration of said second multivibrator means signal pulse.

5. The system of claim 3 wherein said control circuit further comprises a means for latching said encoder means until a reset signal is received thereby for preventing said encoder means from responding to a second command signal.

6. In a system configured on a fixed member for controlling the operation of a sensor on a moving member and including an oscillator for generating a power carrier signal having a frequency and an amplitude, a selection mechanism for providing command signals that select a mode of operation of the sensor a programmable switching means receiving said power carrier signal for modulating said power carrier signal amplitude in accordance with said encoder signals, a resistor receiving said power carrier signal for electrically shunting said programmable switching means, a transmitter for receiving and transmitting said modulated power carrier signal and a receiver means positioned on the moving member for receiving said transmitted modulated power carrier signal and providing control signals to the sensor in accordance therewith, a telemetry encoder apparatus comprising:

an encoder means for providing signals indicative of a threshold number of digital signal pulses corresponding to said selected mode of operation of said sensor;

an electronic switching counter receiving digital signal pulses and said encoder signals, said electronic switching counter for counting said digital signal pulses and providing a halt signal when the number of said digital signal pulses equals said threshold number;

a first multivibrator means for generating a signal pulse of a first preselected duration:

a digital signal pulse generator for periodically providing said digital signal pulses;

an electronic output switch for receiving and transmitting said digital signal pulses and said first multivibrator means signal in the absence of said halt signal; and a control circuit for providing said digital signal pulses only after the termination of said first multivibrator means signal pulse.

7. The apparatus of claim 6 wherein said control circuit further comprises a second multivibrator means for generating a signal pulse of a second preselected duration to said electronic output switch for halting the operation thereof during the duration of said second multivibrator means signal pulse.

8. The apparatus of claim 6 wherein said control circuit further comprises a means for latching said encoder means until a reset signal is received thereby for preventing said encoder means from responding to a second command signal.

* * * * *

UNITED STATES PATENT AND TRADEMARK OFFICE

CERTIFICATE OF CORRECTION

PATENT NO. : 5,144,299

DATED : September 1, 1992

INVENTOR(S) : David C. Smith

It is certified that error appears in the above-identified patent and that said Letters Patent is hereby corrected as shown below:

Column 1

Line 28, delete "o" and substitute --on--.

Column 4

Line 61, delete "five" and substitute --fixed--.
Line 68, delete "encoding" and substitute --encoder--.

Column 5

Line 10, after "means", insert --;--.
Line 39, delete "half" and substitute --halt--.
Line 49, delete "half" and substitute --halt--.
Line 52, delete "pulses" and substitute --pulse--.

Signed and Sealed this

Twenty-fourth Day of August, 1993

Bruce Lehman

*Attest:*

BRUCE LEHMAN

*Attesting Officer*

*Commissioner of Patents and Trademarks*